United States Patent [19]

Gardner et al.

[11] Patent Number: 4,872,513

[45] Date of Patent: Oct. 10, 1989

[54] CHIMNEY FIRE EXTINGUISHER

[75] Inventors: Stanley D. Gardner, Vernon, Canada; Wilfred J. Finnigan, R.R. #Site 4, Comp. 4, Vernon, British Columbia, Canada, V1T 7Z3

[73] Assignee: Wilfred J. Finnigan, Vernon, Canada

[21] Appl. No.: 298,834

[22] Filed: Jan. 18, 1989

Related U.S. Application Data

[63] Continuation of Ser. No. 852,997, Apr. 17, 1986, abandoned, which is a continuation-in-part of Ser. No. 683,574, Dec. 19, 1984, abandoned.

[30] Foreign Application Priority Data

Feb. 19, 1986 [EP] European Pat. Off. ..... 86301178.9

[51] Int. Cl.[4] ..... A62C 37/12

[52] U.S. Cl. ..... 169/57; 169/65; 169/70; 169/17; 169/20; 239/468

[58] Field of Search ..... 169/9, 17, 20, 23, 26, 169/37, 41, 42, 54, 56, 57, 58, 59, 60, 65, 70; 239/468

[56] References Cited

U.S. PATENT DOCUMENTS

| | | | |
|---|---|---|---|
| 922,456 | 5/1909 | Casey | 169/23 X |
| 1,078,388 | 11/1913 | Van Auken | 169/20 |
| 1,616,974 | 2/1927 | Josephson | 169/57 X |
| 2,297,808 | 10/1942 | Soucy | 169/54 X |
| 3,135,330 | 6/1964 | Hanson et al. | 169/54 X |
| 3,326,473 | 6/1967 | Wahlin | 239/468 |
| 3,834,462 | 9/1974 | Orloff et al. | 169/17 |
| 4,034,813 | 7/1977 | Le Day | 169/37 X |
| 4,047,572 | 9/1977 | Stary et al. | 169/70 X |
| 4,341,267 | 7/1982 | Lagasse | 169/54 |
| 4,527,635 | 7/1985 | Kirchner | 169/57 X |

FOREIGN PATENT DOCUMENTS

| | | | |
|---|---|---|---|
| 45104 | 11/1910 | Austria | 169/9 |
| 1161805 | 2/1984 | Canada | 169/56 |

*Primary Examiner*—Sherman D. Basinger
*Assistant Examiner*—Paul E. Salmon
*Attorney, Agent, or Firm*—John J. Leavitt; William A. Blake

[57] ABSTRACT

A chimney fire extinguisher includes a small diameter narrow conduit removably insertable through a small aperture in a chimney wall. A source of fire extinguishate under pressure is coupled to one end of the conduit for delivery of the extinguishate through the conduit. A sprinkler head is fixed to the opposite end of the conduit for insertion through the chimney wall aperture. The sprinkler head comprises an enclosed chamber, a restrictor for restricting the flow of extinguishate from the conduit into the chamber, a small orifice for spraying extinguishate from the chamber into the chimney and a fusible seal for normally sealing the sprinkler head orifice. In an alternate embodiment the sprinkler head orifice is not sealed but is only loosely covered. A temperature sensor is provided for sensing the temperature within the chimney. A valve which is opened in response to the detection of chimney temperatures in excess of about 1200° F. controls the flow of extinguishate from the pressurized source to the sprinkler head.

13 Claims, 1 Drawing Sheet

FIG. 1
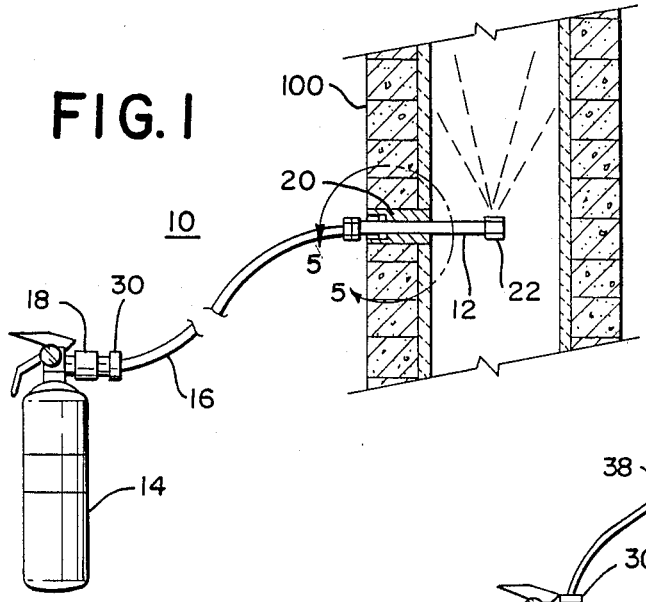
FIG. 2
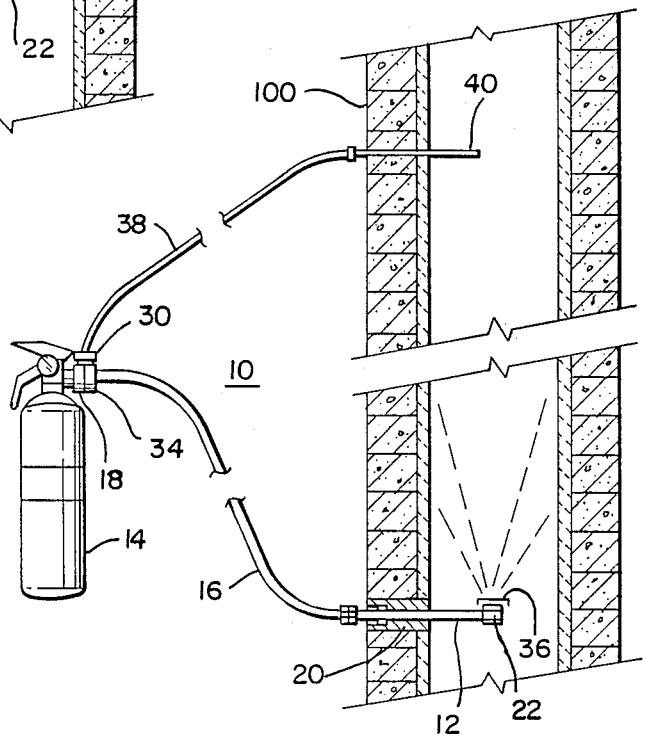
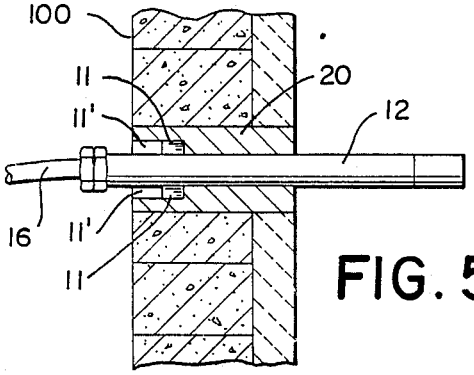
FIG. 5
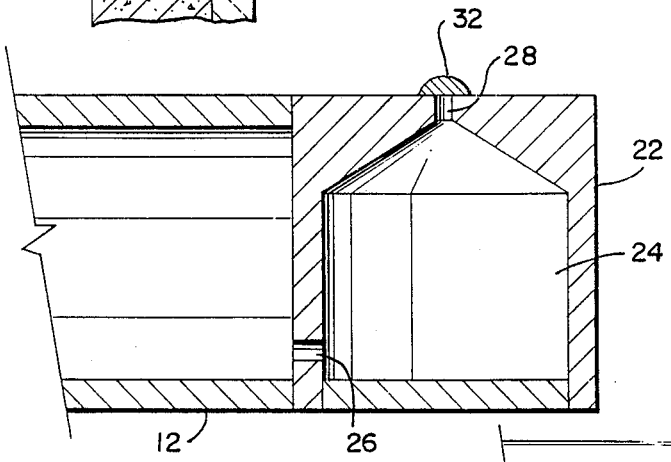
FIG. 3
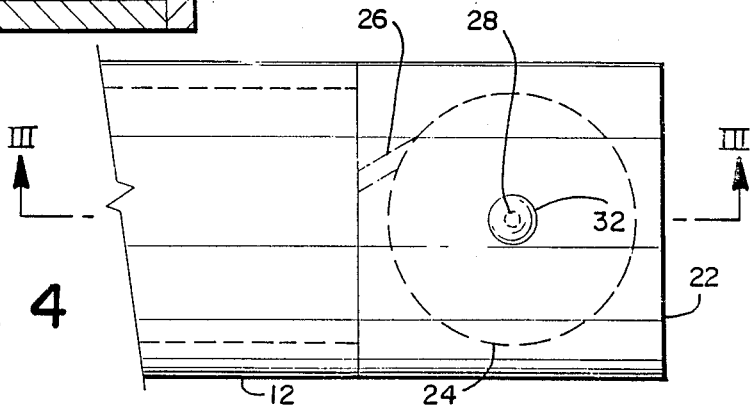
FIG. 4

CHIMNEY FIRE EXTINGUISHER

REFERENCE TO RELATED APPLICATION

This application is a continuation of application Ser. No. 06/852,997, filed Apr. 17, 1986 now abandoned and a continuation-in-part of U.S. application Ser. No. 683,574 filed Dec. 19, 1984, now abandoned.

FIELD OF THE INVENTION

This application pertains to chimney fire extinguishers. More particularly, the application pertains to a chimney fire extinguisher having a relatively narrow or small diameter cross-section which may be removably inserted through a chimney wall to position a sprinkler head within the chimney. The sprinkler head is designed to spray a fine mist of pressurized extinguishate up into the chimney. The extinguishate is normally prevented from passing through the sprinkler head by a fusible sealing means which melts at chimney temperatures generated only by a fire condition within the chimney.

BACKGROUND OF THE INVENTION

The prior art has evolved a number of chimney fire extinguishers. These typically provide a source of pressurized extinguishate and a conduit for conveying extinguishate from the source to a sprinkler head or nozzle which discharges the extinguishate into the chimney. U.S. Pat. No. 4,341,267 issued July 27, 1982 for an invention of Guy Lagasse is typical of the prior art. Lagasse provides what appears to be a conventional building type sprinkler head which is normally held closed by a link "made of a metal with a low melting point so that it melts at a temperature that is symptomatic of fire in the chimney". Unfortunately, the fusible links incorporated in conventional building fire sprinklers are not capable of remaining intact when exposed to temperatures in excess of about 500° F. However, temperatures exceeding 500° F. are often encountered in chimneys, although such temperatures are not considered to be symptomatic of fire conditions within the chimney unless they exceed 1000° F. Accordingly, prior art arrangements of the type exemplified by the Lagasse patent are prone to false alarm triggering and consequential damage and disruption within the premises associated with the chimney.

Canadian Pat. No. 1,161,805 issued Feb. 7, 1984 for an invention of Stephen Aderneck further exemplifies the prior art. Aderneck provides a discharge nozzle which is positioned within the chimney. When Aderneck's apparatus is triggered (again by the melting of a fusible link, which also appears to be prone to false alarm triggering for the reasons given above) extinguishate is discharged through the nozzle and forced down the chimney. Aderneck's arrangement will apparently discharge a relatively large volume of liquid extinguishate down the chimney. This is disadvantageous for several reasons. First, the relatively heavy liquid extinguishate material will be forced down the chimney in a relatively short time span, thus removing the extinguishate from the chimney fire area in which it is needed to extinguish the fire. Second, experience has shown that chimney fires cannot always be extinguished by subjecting them to relatively short bursts of liquid extinguishate; rather, reasonably prolonged application of extinguishate is required to extinguish many chimney fires. The relatively small quantity of extinguishate available in pressurized extinguishate sources normally intended for coupling to chimney fire extinguishing systems is unfortunately rapidly exhausted when discharged as a liquid stream through prior art arrangements of the type just described. The inventors have found that a preferable technique is to spray a relatively fine mist of extinguishate *up* into the chimney where it may hover for a reasonably prolonged time in the vicinity of the fire, thus maximizing the fire extinguishing action. All too often, prior art arrangements of the sort described above apply relatively little extinguishate to the chimney fire, the bulk of the extinguishate material passing down the chimney without affecting the chimney fire, but falling onto the fire in the grate, thereby generating large quantities of smoke which may impede efforts to extinguish the fire, and cause smoke or liquid damage to the premises associated with the chimney.

A further significant disadvantage of prior art arrangements of the type hereinbefore described is that they are awkward to install and remove. For example, the Lagasse apparatus is apparently preferably mounted at the top of the chimney on a support bracket fixed to the outside wall of the chimney. This is rather unsightly, renders the apparatus relatively inaccessable and exposes it to the elements. Aderneck provides a variety of support brackets for holding the various components of his system in their intended positions. This arrangement is also relatively cumbersome to install and service.

The applicant provides a chimney fire extinguisher which overcomes the foregoing disadvantages. More particularly, the applicant provides a novel sprinkler head for discharging a fine mist of extinguishate material up into the chimney for maximal effect in extinguishing chimney fires. The extinguishate material is normally prevented from passing through the sprinkler head by a fusible sealing means which does not melt until chimney temperatures on the order of 1200° F. are attained, thereby minimizing possible false triggering of the apparatus. The applicant's apparatus is also constructed for removable insertion through a relatively small aperture in a wall of the chimney. This arrangement facilitates rapid removal of the apparatus for servicing of the apparatus or for cleaning the chimney and also ensures location of the sprinkler head in a preselected position from which extinguishate may be discharged into the chimney for maximal fire extinguishing effect.

SUMMARY OF THE INVENTION

The invention provides, in a first embodiment, a chimney fire extinguisher comprising a narrow conduit which is removably insertable through a small aperture in a chimney wall. A source of fire extinguishate is coupled to one end of the conduit so that the extinguishate may be delivered through the conduit. A sprinkler head is fixed to the opposite end of the conduit for insertion through the chimney wall aperture. The sprinkler head comprises an enclosed chamber, a restrictor for restricting the flow of extinguishate from the conduit into the chamber, a small orifice for spraying extinguishate from the chamber into the chimney, and a fusible sealing means for normally sealing the orifice.

Preferably, the sprinkler head chamber is cylindrical in cross-section in the region where the restrictor communicates between the conduit and the chamber; and, the restrictor is positioned to direct extinguishate flow approximately tangentially to the interior wall of the chamber, whereby the extinguishate is caused to swirl rapidly around the chamber, which tends to atomize the extinguishate. The chamber cross-section also preferably narrows in the direction towards the orifice. Advantageously, the fusible sealing means comprises a solder having a melting point above about 1200° F.

In a second embodiment the invention provides a chimney fire extinguisher comprising a narrow conduit removably insertable through a small aperture in a chimney wall; a source of fire extinguishate coupled to one end of the conduit for delivery of the extinguishate therethrough; a sprinkler head fixed to the opposite end of the conduit for insertion through the aperture, the sprinkler head comprising an enclosed chamber, a restrictor for restricting the flow of extinguishate from the conduit into the chamber, a small orifice for spraying extinguishate from the chamber into the chimney, and a blow off cover for normally covering the orifice. The chimney fire extinguisher of the second embodiment also comprises temperature sensing means for detecting temperatures within the chimney in excess of about 1200° F.; and, valve means openable in response to such detection for controlling the flow of extinguishate from the source into the conduit.

Preferably, the second embodiment also comprises a capillary tube for air communication between the valve means and the temperature sensing means. The temperature sensing means in this instance may comprise a fusible sealing means for sealing pressurized air within the tube to maintain the valve means in the closed position. Chimney temperatures in excess of about 1200° F. melt the sealing means, thereby releasing the pressurized air and enabling opening of the valve means.

BRIEF DESCRIPTION OF THE DRAWINGS

FIG. 1 is a schematic illustration of a chimney fire extinguisher according to a first embodiment of the invention;

FIG. 2 is a schematic illustration of a chimney fire extinguisher according to a second embodiment of the invention.

FIG. 3 is a cross-sectional illustration of the preferred sprinkler head assembly, taken with respect to line III—III of FIG. 4 and shown enlarged with respect to the scale of FIGS. 1 and 2; and, FIG. 4 is a top plan view of the preferred sprinkler head assembly, shown enlarged with respect to the scale of FIGS. 1 and 2;

FIG. 5 is a fragmentary cross-sectional view taken in the plane indicated by the line 5—5 in FIG. 1.

DETAILED DESCRIPTION OF THE PREFERRED EMBODIMENTS

Two separate embodiments of the invention will be described. The first embodiment (depicted in FIG. 1) incorporates fusible sealing means on the sprinkler head. The second embodiment (depicted in FIG. 2) provides a temperature sensing means (which is itself preferably a fusible sealing means) which may be positioned in the chimney remote from the location at which the sprinkler head is positioned. The first embodiment of the invention is for use in situations where it is desired to position the sprinkler head within that portion of the chimney in which a fire may be expected to occur. The second embodiment is for use in situations where it is desired to position the sprinkler head at a point somewhat remote from the chimney portion in which a fire may be expected to occur. For example, the sprinkler head of the second embodiment may be positioned in the chimney cleanout, below the level of the fire grate, so as to direct extinguishate up into the chimney. In the second embodiment the temperature sensing means is positioned in that portion of the chimney in which fires may be expected to occur. The second embodiment is particularly suited to situations where it may be difficult to gain access to the sprinkler assembly, once mounted within the chimney as hereinafter described, to enable removal of the sprinkler assembly for purposes of cleaning the chimney, servicing the sprinkler assembly, etc. Furthermore, since it is desirable that the sprinkler assembly be installed as low as possible in the chimney, in order to maximize that portion of the chimney which may be exposed to extinguishate delivered from the sprinkler head, it may in some cases be desirable to utilize the second embodiment of the invention, even though there may be no problem gaining access to the installed sprinkler assembly.

The first embodiment illustrated in FIG. 1 provides a chimney fire extinguisher generally designated 10 having a narrow, rigid conduit 12 which is removably insertable through a small aperture in chimney wall 100. A pressurized source 14 of fire extinguishate is coupled to one end of conduit 12 via flexible hose 16 such that the fire extinguishate may be delivered through hose 16 and conduit 12. Although extinguishate source 14 is illustrated as a conventional manually operated extinguisher, it is automatically triggered as hereinafter explained. Indeed, the manual triggering mechanism may be removed, or a source having no such manual mechanism may be utilized.

Preferably, a pressure sensitive switch 18 is coupled into the extinguishate delivery circuit and electronically connected to an audible or visual alarm (or both-neither illustrated). Pressure sensitive switch 18 detects a drop in pressure in the extinguishate delivery circuit which is indicative of triggering of fire extinguisher 10 and thus enables activation of the alarm(s) to warn of the apparent detection of a chimney fire.

Sleeve 20 is snugly mounted within a small aperture bored into chimney side wall 100 at a location which is conveniently accessible and which is relatively close to the base of the chimney. Releasable connecting means such as projecting lugs 11 are provided on conduit 12 to engage mating slots 11 cut into sleeve 20, thereby facilitating releasable latching of conduit 12 in place within sleeve 20. This enables rapid installation and removal of conduit 12 for servicing, cleaning of the chimney, etc. Sleeve 20 also receives and guides insertion of conduit 12 into the chimney. The releasable latching means aforesaid serves to locate the end of conduit 12 (to which a sprinkler head is attached as hereinafter explained) precisely within the chimney and with the sprinkler head in a preferred orientation for delivering extinguishate upward into the chimney.

Sprinkler head 22 is fixed to the end of conduit 12, opposite the end to which flexible hose 16 and pressurized extinguishate source 14 are coupled. As may be seen in FIG. 3, sprinkler head 22 comprises an enclosed chamber 24 into which extinguishate passing through conduit 12 is delivered through a narrow passage or "restrictor" 26 which restricts the flow of extinguishate from conduit 12 into chamber 24. Accordingly, extinguishate delivered into chamber 24 through restrictor 26 travels at a significantly increased velocity, as compared with the velocity of extinguishate passing through conduit 12. As may be seen in FIG. 4, chamber 24 is preferably cylindrical in cross-section, at least in the region where restrictor passage 26 communicates between conduit 12 and chamber 24. FIG. 4 also illustrates the preferred angled positioning of restrictor passage 26, relative to the longitudinal axis of conduit 12, to direct extinguishate flow approximately tangentially to the interior wall of chamber 24. This causes extinguishate delivered into chamber 24 to swirl rapidly around chamber 24, which assists in atomizing the extinguishate.

As seen in FIG. 3, the cross-sectional area of chamber 24 narrows in the direction toward orifice 28 which is located in the upper central area of chamber 24. The atomized extinguishate is delivered through orifice 28 as a fine, high velocity mist which may be borne up the chimney by the updraft caused by the fire. The mist tends to hover in the chimney, in the region where the fire is, for a relatively long time, as compared with streams of liquid extinguishate typically delivered by prior art extinguishers. Thus, the potential for extinguishing the fire is maximized.

Orifice 28 is normally closed by sealing it with a fusible sealing means comprising a drop of solder 32 having a melting point above about 1200° F. Solder sold under the trade mark EUTEC SILVER 1020 F.C. has been effectively utilized by the inventors.

In operation, sleeve 20 is snugly fitted into an aperture bored at a convenient location in chimney side wall 100 and is oriented to position releasable latching means provided thereon such that, when coupled with mating releasable latching means on conduit 12, sprinkler head 22 will be located centrally within the chimney with orifice 28 facing upward to direct extinguishate up into the chimney. The assembly comprising conduit 12 and sprinkler head 22 may then be guided through sleeve 20 and releasably latched thereto. Flexible hose 16 is connected to couple conduit 12 to pressurized extinguishate source 14. Conduit 12 and flexible hose 16 are then pressurized by introducing a pressurized inert gas through a conveniently located fitting such as valve 30. More particularly, conduit 12 and flexible hose 16 are pressurized with inert gas to a pressure in excess of the pressure to which the extinguishate in source 14 is pressurized. Accordingly, once conduit 12 and flexible hose 16 have been pressurized and valve 30 is closed, pressurized source 14 can be opened to enable extinguishate to pass directly from source 14 through flexible hose 16 and conduit 12 to sprinkler head 22. Of course, the pressurized extinguishate is normally held back within pressurized source 14 because the inert gas pressure in conduit 12 and flexible hose 16 exceeds the pressure of the extinguishate within source 14. This dispenses with the need for a means for sensing a fire condition within the chimney which is capable of releasing the extinguishate from source 14, such means being prone to failure. If the extinguishate were not restrained within source 14 in some manner then it would flow through flexible hose 16 and conduit 12. Extinguishate within conduit 12 (which is preferably made of a metal such as stainless steel to resist high temperatures) might then be vapourized if exposed to high temperatures radiated from the chimney through conduit 12. Such vapourization is potentially hazardous since it could significantly increase the pressure within the system comprising conduit 12, flexible hose 16 and pressurized source 14.

Under normal conditions the temperature within the chimney will be well below 1000° F. Conventional masonry flues are designed to sustain temperatures of no more than about 1000° F. However, under chimney fire conditions the temperature within the chimney will rapidly exceed 1200° F. When the temperature in the vicinity of sprinkler head 22 reaches about 1200° F. solder 32 sealing orifice 28 melts, thus enabling the pressurized inert gas within conduit 12 to blow the solder away from and clear orifice 28. The opening of orifice 28 enables the inert gas to escape. Accordingly, the pressure within conduit 12 and flexible hose 16 rapidly drops below the pressure of the extinguishate within source 14 which in turn enables the extinguishate to pass through flexible hose 16 and conduit 12 and through sprinkler head 22 for delivery into the chimney in the manner aforesaid. Pressure sensitive switch 18 detects the drop in pressure within the extinguishate delivery circuit and produces a signal to activate one or more optional alarms.

When the extinguishate is spent and the fire has been extinguished conduit 12 and sprinkler head 22 can be rapidly withdrawn from the chimney by releasing the latching means coupling them to sleeve 20. The chimney can then be cleaned and a fresh drop of solder applied to reseal orifice 28. Pressurized source 14 is recharged with pressurized extinguishate and flexible hose 16 and conduit 12 are repressurized with inert gas as described above to restrain the extinguishate within source 14. Once conduit 12 and sprinkler head 22 are recoupled within sleeve 20 the system is again ready for use.

The second embodiment of the invention illustrated in FIG. 2 is generally similar to the first embodiment described above. The principal differences between the first and second embodiments will now be described. In the second embodiment a valve 34 is provided to restrain pressurized extinguishate within source 14. In this case flexible hose 16 and conduit 12 are not pressurized with inert gas. Further, orifice 28 is not sealed with solder, but is merely temporarily covered with a loosely fitting blow off cover 36 which can easily be dislodged by spraying extinguishate through orifice 28.

A capillary tube 38 is coupled between valve 34 and a temperature sensing means 40 which is located within the chimney at a point where a chimney fire may be reasonably expected to occur. A plurality of such temperature sensing means may, if desired, be located at various points within the chimney and similarly coupled to valve 34. In the preferred embodiment temperature sensing means 40 is itself a fusible sealing means such as the solder described above with reference to the first embodiment. The solder seals the end of capillary tube 38 located within the chimney. Accordingly, capillary tube 38 may be pressurized with air or an inert gas. The pressure within capillary tube 38 is sufficient to hold valve 34 in the closed position, thereby restraining the extinguishate within pressurized source 14 (valve 34 is in this case a normally open air diaphragm valve which operates in response to changes in the pressure differential on opposite sides of the diaphragm).

If the temperature within the chimney exceeds about 1200° F. the solder sealing the end of capillary tube 38 melts, thereby releasing the pressurized air or inert gas within capillary tube 38, such that the pressure tending to hold valve 34 closed rapidly falls below the pressure of the extinguishate in source 14. This in turn enables valve 34 to open and allows the pressurized extinguishate within source 14 to pass through flexible hose 16 and conduit 12 for delivery through sprinkler head 22 in the manner aforesaid.

It will thus be understood that the second embodiment of the invention may be used in situations where it may be inconvenient or undesirable to locate conduit 12 in a position where sprinkler head 22 protrudes directly into a portion of the chimney in which fires may reasonably be expected to occur. In the second embodiment of the invention only temperature sensing means 40 (which could be an electronic temperature sensitive device, in which case valve 34 would be selected to be responsive to output signals produced by the electronic temperature sensitive device) need be positioned within that portion of the chimney in which fires may reasonably be expected to occur. The balance of the apparatus consisting of conduit 12 and sprinkler head 22 may be positioned well below that portion of the chimney in which fires may occur. Indeed, if desired, conduit 12 and sprinkler head 22 could be positioned in the cleanout area below the level of the fire grate, if the chimney includes a passage communicating from the cleanout area into that portion of the chimney in which fires may occur.

Those skilled in the art will readily appreciate that a number of variations may be made to either of the embodiments hereinbefore described. Accordingly, the invention is to be limited only by the scope of the claims appended hereto.

We claim:

1. A chimney fire extinguisher, comprising:

(a) a narrow conduit removably insertable through a small aperture in a chimney wall;

(b) a source of fire extinguishate coupled to one end of said conduit for delivery of extinguishate therethrough;

(c) a sprinkler head fixed to the opposite end of said conduit for insertion through said aperture, said sprinkler head comprising:

(i) an enclosed chamber;

(ii) a restrictor for restricting the flow of extinguishate from said conduit into said chamber;

(iii) a small orifice for spraying extinguishate from said chamber into the chimney;

(iv) fusible sealing means fused over said orifice for normally sealing said orifice; and (d) a sleeve rigidly mountable within said aperture to receive and guide said conduit into said chimney; said sleeve including at least a first mating slot for receiving at least a first projecting lug on said conduit to releasably latch said conduit in place in in a set orientation within said sleeve.

2. A chimney fire extinguisher as defined in claim 1, wherein:

(a) said chamber is cylindrical in cross-section in the region where said restrictor communicates between said conduit and said chamber; and, (b) said restrictor is positioned to direct extinguishate flow approximately tangentially to the interior wall of said chamber, whereby said extinguishate is caused to swirl around said chamber.

3. A chimney fire extinguisher as defined in claim 2, wherein said chamber cross-section narrows in the direction toward said orifice.

4. A chimney fire extinguisher as defined in claim 3, wherein said fusible sealing means fused over said orifice comprises solder having a melting point above about 1200° F.

5. A chimney fire extinguisher as defined in claim 4, wherein:

(a) said source of fire extinguishate is pressurized to a first pressure;

(b) said conduit is coupled to said source of fire extinguishate pressurized to said first pressure to enable said extinguishate to pass directly into said conduit; and, (c) means within said conduit normally preventing passage of said extinguishate into said conduit.

6. A chimney fire extinguisher as defined in claim 5, wherein said means within said conduit normally preventing passage of said extinguishate comprises a body of inert gas contained within said conduit and pressurized to a pressure greater than said first pressure to which said source of extinguishate is pressurized.

7. The chimney five extinguisher of claim 1 wherein said sprinkler head orifice faces upward to direct extinguishate up into the chimney when said conduit projecting lug is received in said mating slot.

8. A chimney fire extinguisher, comprising:

(a) a narrow conduit removably insertable through a small aperture in a chimney wall;

(b) a source of fire extinguishate coupled to one end of said conduit for delivery of extinguishate therethrough;

(c) a sprinkler head fixed to the opposite end of said conduit for insertion through said aperture, said sprinkler head comprising:

(i) an enclosed chamber;

(ii) a restrictor for restricting the flow of extinguishate from said conduit into said chamber;

(iii) a small orifice for spraying extinguishate from said chamber into the chimney; and, (iv) a blow off cover for normally covering said orifice;

(d) temperature sensing means for detecting temperatures within said chimney excess of about 1200° F.;

(e) valve means operable in response to said detection, for controlling the flow of said extinguishate from said source into said conduit; and, (f) a sleeve rigidly mountable within said aperture to receive and guide insertion of said conduit into said chimney; said sleeve including at least a first mating slot for receiving at least a first projecting lag on said conduit to releasably latch said conduit in place in a set orientation within said sleeve.

9. A chimney fire extinguisher as defined in claim 8, wherein:

(a) said chamber is cylindrical in cross-section in the region where said restrictor communicates between said conduit and said chamber; and, (b) said restrictor is positioned to direct extinguishate flow approximately tangentially to the interior wall of said chamber, whereby said extinguishate is caused to swirl around said chamber.

10. A chimney fire extinguisher as defined in claim 9, wherein said chamber cross-section narrows in the direction toward said orifice.

11. A chimney fire extinguisher as defined in claim 8, further comprising a capillary tube for air communication between said valve means and said temperature sensing means; and wherein said temperature sensing means comprises fusible sealing means for sealing pressurized air within said tube to maintain said valve means in the closed position; whereby chimney temperatures in excess of about 1200° F. melt said sealing means, thereby releasing said pressurized air and enabling opening of said valve means.

12. The chimney fire extinguisher of claim 8 wherein said sprinkler head orifice faces upward to direct extinguishate up into the chimney when said conduit projecting lug is received in said mating slot.

13. A chimney fire extinguisher, comprising:

(a) a narrow conduit removably insertable through a small aperture in a chimney wall;

(b) a source of fire extinguishate coupled to one end of said conduit for delivery of extinguishate therethrough;

(c) a sprinkler head fixed to an opposite end of said conduit for insertion through said aperture, said sprinkler head comprising:

(i) an enclosed chamber;

(ii) a restrictor for restricting the flow of extinguishate from said conduit into said chamber;

(iii) a small upwardly facing orifice for spraying extinguishate said chamber up into the chimney; and, (iv) fusible sealing means fused over said orifice for normally sealing said orifice.

* * * * *